US010508476B2

(12) United States Patent
Handke

(10) Patent No.: US 10,508,476 B2
(45) Date of Patent: Dec. 17, 2019

(54) ELECTRIC VEHICLE DOOR LOCK WITH INCREASED OPERATING RELIABILITY

(71) Applicant: Kiekert Aktiengesellschaft, Heiligenhaus (DE)

(72) Inventor: Armin Handke, Duisburg (DE)

(73) Assignee: Kiekert Aktiengesellschaft, Heiligenhaus (DE)

( * ) Notice: Subject to any disclaimer, the term of this patent is extended or adjusted under 35 U.S.C. 154(b) by 323 days.

(21) Appl. No.: 15/115,739

(22) PCT Filed: Feb. 2, 2015

(86) PCT No.: PCT/DE2015/000033
§ 371 (c)(1),
(2) Date: Aug. 1, 2016

(87) PCT Pub. No.: WO2015/113545
PCT Pub. Date: Aug. 6, 2015

(65) Prior Publication Data

US 2017/0159331 A1 Jun. 8, 2017

(30) Foreign Application Priority Data

Jan. 31, 2014 (DE) ..... 10 2014 001 160

(51) Int. Cl.
*E05B 77/12* (2014.01)
*E05B 81/16* (2014.01)
(Continued)

(52) U.S. Cl.
CPC ..... *E05B 77/12* (2013.01); *E05B 81/16* (2013.01); *E05B 81/90* (2013.01); *E05B 83/34* (2013.01)

(58) Field of Classification Search
CPC ..... E05B 77/12; E05B 81/14; E05B 81/16; E05B 81/90; E05B 83/34; E05B 77/14;
(Continued)

(56) References Cited

U.S. PATENT DOCUMENTS 3,746,381 A * 7/1973 Colombo ..... E05C 3/24 292/216
6,050,117 A * 4/2000 Weyerstall ..... E05B 77/12 292/201
(Continued)

FOREIGN PATENT DOCUMENTS

CN 1607311 A 4/2005
CN 1904298 A 1/2007
(Continued)

OTHER PUBLICATIONS

Office Action of CN Application No. 201580006454.2 dated Jan. 29, 2018.
(Continued)

*Primary Examiner* — Nathan Cumar
(74) *Attorney, Agent, or Firm* — Renner, Otto, Boisselle & Sklar, LLP

(57) ABSTRACT

A vehicle door lock comprising: a locking mechanism; an opening actuator for unlocking the locking mechanism; an actuating member for unlocking the locking mechanism; a switching actuator that can be in a normal position or an emergency position, such that in the normal position the switching actuator renders the actuating member inoperable and in the emergency position renders the actuating member operable; and a control unit for controlling the switching actuator; characterised in that the control unit is configured to set the switching actuator from the emergency position into the emergency position and back following a specified cycle.

10 Claims, 7 Drawing Sheets

Figure 1A:
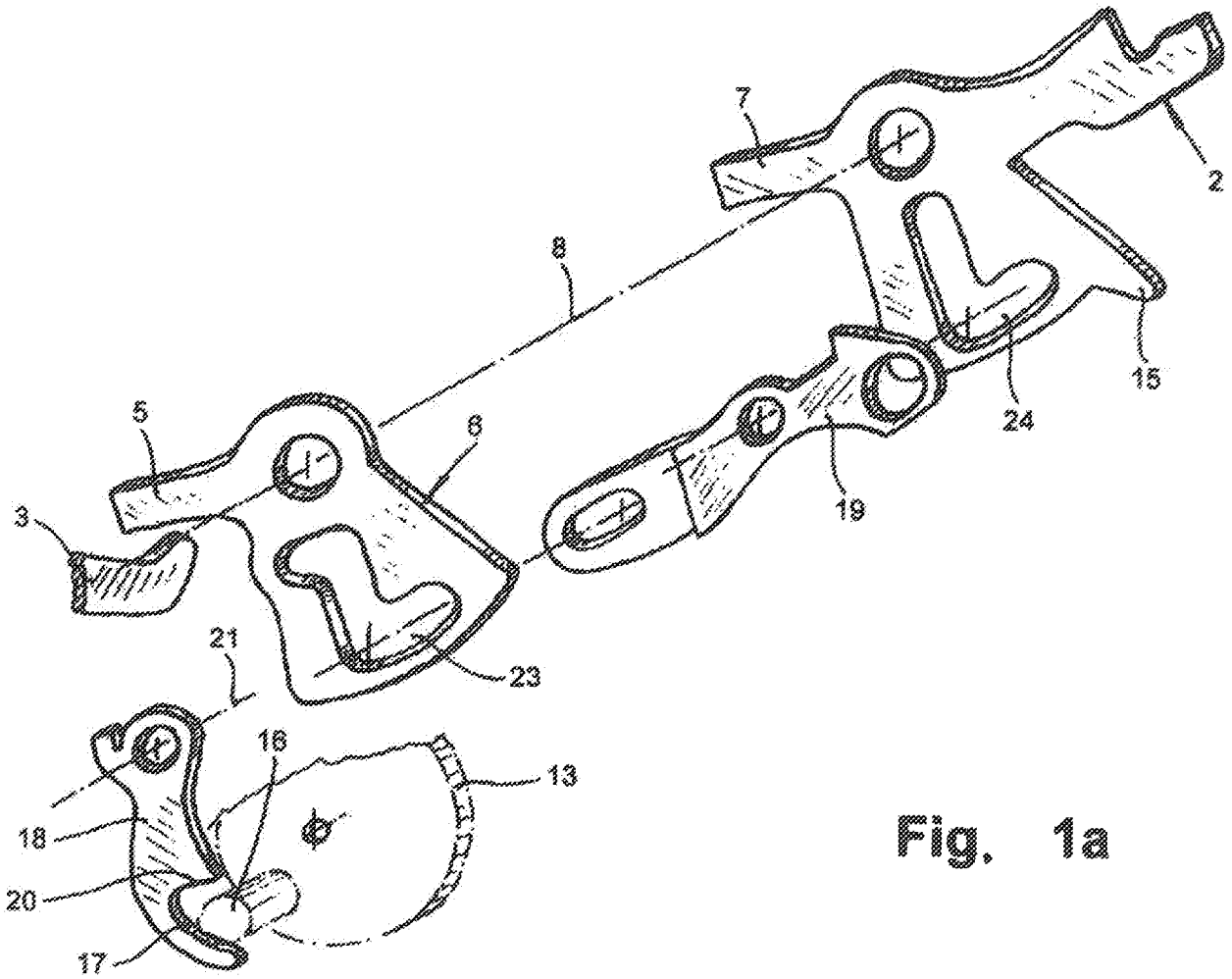

(51) Int. Cl.
*E05B 81/90* (2014.01)
*E05B 83/34* (2014.01)

(58) Field of Classification Search
CPC ..... E05B 77/16; E05B 77/04; E05B 81/15; Y10T 292/696; Y10T 292/699; Y10T 292/702; Y10T 292/60
USPC ..... 292/201
See application file for complete search history.

(56) References Cited

U.S. PATENT DOCUMENTS

| | | | | |
|---|---|---|---|---|
| 7,234,737 | B2 * | 6/2007 | Kalsi | E05B 81/06 292/201 |
| 7,261,335 | B2 * | 8/2007 | Schupp | E05B 77/02 292/201 |
| 2001/0024041 | A1 * | 9/2001 | Barczynski | E05B 77/26 292/216 |
| 2004/0227358 | A1 * | 11/2004 | Kachouh | E05B 81/14 292/216 |
| 2005/0016799 | A1 * | 1/2005 | Severinsson | F16D 65/18 188/156 |
| 2008/0224482 | A1 * | 9/2008 | Cumbo | E05B 77/02 292/216 |
| 2011/0260475 | A1 | 10/2011 | Spurr et al. | |

FOREIGN PATENT DOCUMENTS

| | | | |
|---|---|---|---|
| CN | 102052023 | A | 5/2011 |
| DE | 100 48 709 | A1 | 4/2002 |
| DE | 10048709 | A1 | 4/2002 |
| WO | WO 98/27301 | A2 | 6/1998 |

OTHER PUBLICATIONS

International Search Report and Written Opinion for corresponding Patent Application No. PCT/DE2015/000033 dated Jun. 11, 2015.

* cited by examiner

ELECTRIC VEHICLE DOOR LOCK WITH INCREASED OPERATING RELIABILITY

The present invention relates to a motor vehicle door latch with a locking mechanism and an opening actuator and a procedure for the operation of the same.

Motor vehicle door latches have been known for years. They normally comprise a locking mechanism with a catch which interacts with a locking bolt and a pawl for the catch. Originally, the locking mechanism was unlocked solely with the aid of an actuating mechanism, such as a door handle. Latterly, there has been a development to the extent of unlocking a locking mechanism using an opening actuator. The opening actuator is often an electrical drive; consequently, an electrical motor vehicle door latch can be spoken about overall. However, all other suitable types of actuators can also be used. Consequently, an electrical motor vehicle door latch means all types of actuated motor vehicle door latches. In normal operation of the electrical motor vehicle door latch, the actuating mechanism is deactivated. The locking mechanism is unlocked solely via the opening actuator.

However, it is desirable, in an emergency, for example in the event of power failure or an accident, to be able to unlock the locking mechanism purely manually, i.e. by means of the actuating mechanism. Some electrical motor vehicle door latches demonstrate a switching actuator which activates the actuating mechanism in an emergency.

It is the task of the present invention to provide a motor vehicle door latch with increased operational safety and a procedure for operational securing of a motor vehicle door latch. This is solved by the motor vehicle door latch and the independent claims procedure. Advantageous designs are specified in the dependent claims.

A motor vehicle door latch according to the invention demonstrates a locking mechanism, an opening actuator for unlocking of the locking mechanism, an actuating mechanism for unlocking of the locking mechanism and a switching actuator which can assume a normal position and an emergency position, whereby the switching actuator deactivates the actuating mechanism in the normal position and activates the actuating mechanism in the emergency position. Furthermore, the motor vehicle door latch demonstrates a control unit for controlling the switching actuator. According to the invention, the control unit is set up in such a way as to move the switching actuator in a prescribed cycle from the normal position to the emergency position.

The locking mechanism normally comprises a catch and a pawl. The catch interacts with a locking bolt in order to lock the motor vehicle door or release it for opening. In the locked state of the locking mechanism, the pawl prevents rotation of the catch and thus release of the locking bolt. For conventional motor vehicle door latches, the locking mechanism is solely unlocked by means of an actuating mechanism. The actuating mechanism is in particular a manual actuating mechanism, such as a door handle or a lever, for example. The locking mechanism is thus manually unlocked by means of the actuating mechanism.

In the present motor vehicle door latch, the locking mechanism is unlocked by means of the opening actuator. When a relevant signal is generated, for example by pressing a button or exerting a force on the actuating mechanism, the opening actuator is relevantly controlled in order to unlock the locking mechanism. Normally, the actuating mechanism is deactivated by means of the switching actuator. Consequently, activation of the actuating mechanism is prevented for example or does not lead to unlocking of the locking mechanism.

If an emergency occurs, especially in the case of an accident or after recognition of an overload (time-controlled) or in the case of disruption to the energy supply of the opening actuator, the control unit controls the switching actuator in such a way that it moves from its normal position to its emergency position. The actuating mechanism is thus activated and the locking mechanism can be manually unlocked in particular by means of the actuating mechanism.

According to the invention, the control unit is set up in such a way that the switching actuator (additional) is moved in a prescribed cycle from the normal position to the emergency position, i.e. in particular regardless of the presence of an emergency. As an emergency occurs very rarely, the activation of the actuating mechanism using the switching actuator is accordingly rare. This can lead to it being impossible to activate the actuating mechanism due to the long non-use of this function, for example due to a blockage of the switching actuator or an associated mechanism. In the case of long non-use of this function, one or several components necessary for activation of the actuating mechanism can become jammed. This is prevented by the switching actuator being moved out of the normal position into the emergency position even when no emergencies occur. This keeps the switching actuator and a potentially associated mechanism moving.

The movement of the switching actuator from the normal position to the emergency position in the prescribed cycle preferably includes the subsequent movement of the switching actuator back out of its emergency position into the normal position. It can include in particular multiple movements of the switching actuator from the normal position into the emergency position and back again.

Preferably, the control unit not only controls the switching actuator, but also the opening actuator. The control unit is preferably connected to a sensor to this end which generates a relevant start signal if the locking mechanism is to be unlocked by the opening actuator. For example, the sensor detects the activation of a button or a force impact on a door handle.

An actuator, therefore in particular the opening actuator and/or the switching actuator can be of a suitable type. An actuator contains an electrical drive in particular, but it can also contain, for example, a magnetic, hydraulic, pneumatic or piezoelectric drive. In addition to the drive, the actuator can contain a further mechanism, in particular a gearbox. In principle, an actuator, which can also be described as an actor, is a component or a module which converts a control signal, in particular an electrical signal, into a mechanical movement. In contrast, an actuating mechanism is a component which is manually activated, therefore is in particular moved by the application of a force by an operator.

In one design of the invention, the opening actuator and the switching actuator become the same actuator. This actuator then demonstrates at least three positions, namely a first position in which the actuating mechanism is deactivated and the locking mechanism is locked, a second position in which the actuating mechanism is deactivated and the locking mechanism is unlocked, and a third position in which the actuating mechanism is activated. In the third position the locking mechanism is preferably not blocked by the actuator. Consequently, the locking mechanism can be unlocked by activation of the actuating mechanism. The first and second positions are both normal positions for the actuator in its function as a switching actuator. The term 'normal position' can thus include more than one actuator position.

In one design of the invention, the motor vehicle door latch demonstrates a bolt driven by the switching actuator which blocks and thus deactivates the actuating mechanism in the normal position of the switching actuator. In the emergency position of the switching actuator the bolt does not block the actuating mechanism. Consequently, activation of the actuating mechanism can unlock the locking mechanism. In this design, the term 'blocking' not only means complete prevention of a movement of the actuating mechanism, for example relative to a motor vehicle door in which the motor vehicle door latch is installed, but also includes the case in which such a movement of the actuating mechanism is possible which does not unlock the locking mechanism. However, the movement can be detected, for example, to generate a control signal for controlling the opening actuator so that it unlocks the locking mechanism. The bolt can, for example, be a slide bolt, i.e. a translationally moved bolt, a pivoting bolt, or a combination thereof.

In one design of the invention the motor vehicle door latch demonstrates a coupling mechanism driven by the switching actuator which, in the normal position of the switching actuator moves the actuating mechanism with regard to the locking mechanism into an idle stroke and thus deactivates it. In the emergency position of the switching actuator, the coupling mechanism generates a coupling between the actuating mechanism and the locking mechanism, consequently activation of the actuating mechanism unlocks the locking mechanism. Due to the idle stroke, the actuating mechanism can be activated, i.e. moved, in particular relative to a motor vehicle door in which the motor vehicle door latch is installed. However, this activation does not lead to unlocking of the locking mechanism.

In one design of the invention the prescribed cycle corresponds to a number of openings of the locking mechanism by the opening actuator. 'Opening of the locking mechanism' in particular means the unlocking of the locking mechanism. If therefore the prescribed number of openings of the locking mechanism takes place by the opening actuator, the switching actuator is moved from the normal position to the emergency position, even if no emergency has occurred. The number of openings of the locking mechanism, which defines the prescribed cycle, is 100, 200, 500, 1000, 2000 and more.

In one design of the invention the prescribed cycle corresponds to the n-fold opening of a tank lid of a motor vehicle in which the motor vehicle door latch is installed, whereby n is a positive whole number. In particular, the control unit has a signal input to receive the signal which displays the opening of the tank lid. The control unit adds up how often such a signal sits closely at the input and moves the switching actuator from the normal position to the emergency position if this total reaches the number n. In this design n is 10, 20, 25, 50 or 100, for example.

In one design of the invention, the prescribed cycle corresponds to the n-fold connection of a diagnostic device to the vehicle electronics of a motor vehicle in which the motor vehicle door latch is installed, whereby n is a positive whole number. The control unit preferably demonstrates an interface for connection to the motor vehicle electronics, via which the control unit can receive a signal which displays connection of a diagnostic device to the vehicle electronics. The control unit can also be integrated into the vehicle electronics; consequently, it does not require an interface to connect to the vehicle electronics. The diagnostic device is connected in particular to the vehicle electronics in an inspection, i.e. normally once per year. In this design, n is 1, 2, 3, 4, 5 or more, for example.

In one design of the invention, the prescribed cycle corresponds to the n-fold starting of the engine of a motor vehicle in which the motor vehicle door latch is installed, whereby n is a positive whole number. The control unit demonstrates an interface in particular, via which the control unit can receive a signal which displays the starting of the engine. The control unit can, for example, be connected to the vehicle electronics or a sensor in the ignition latch via the interface. However, the control unit can also be a component of the vehicle electronics. In this design, n can be 10, 20, 25, 50, 100, 200, 250 or 500, for example.

In the last designs, the cycle was defined as the number of occurrences of a certain event. If a prescribed number is attained, the control unit moves the switching actuator into its emergency position and preferably resets the counter for the number of occurrences, in particular to the value 0. Furthermore, the prescribed cycle can be a temporal cycle. The control unit therefore moves the switching actuator after lapse of a certain time span from a starting time from a normal position to an emergency position. For example, the starting time is the time at which the opening actuator was last moved to the emergency position, the time of manufacture of the motor vehicle door latch, the time of installation of the motor vehicle door latch or the time of the last maintenance of the motor vehicle door latch. For example, after the lapse of 1, 2, 3, 6, 12, 18 or 24 months the switching actuator is moved from the normal position to the emergency position and back.

Furthermore, the present invention involves a process for operational securing of a motor vehicle door latch with a locking mechanism, an opening actuator to unlock the locking mechanism, an actuating mechanism to unlock the locking mechanism and a switching actuator which can assume a normal position and an emergency position, whereby the switching actuator deactivates the actuating mechanism in the normal position and activates the actuating mechanism in the emergency position. According to the procedure, the switching actuator is moved from the normal position to the emergency position and back in a prescribed cycle, in particular independently of the existence of an emergency.

The present invention is capable of combining individual designs with regard to a single and several characteristics of the designs to be combined.

The present invention should be explained in further detail on the basis of an execution example with pertaining figures. The execution example is based on the motor vehicle door latch as described in document DE 100 48 709 A1.

Figure 1B:
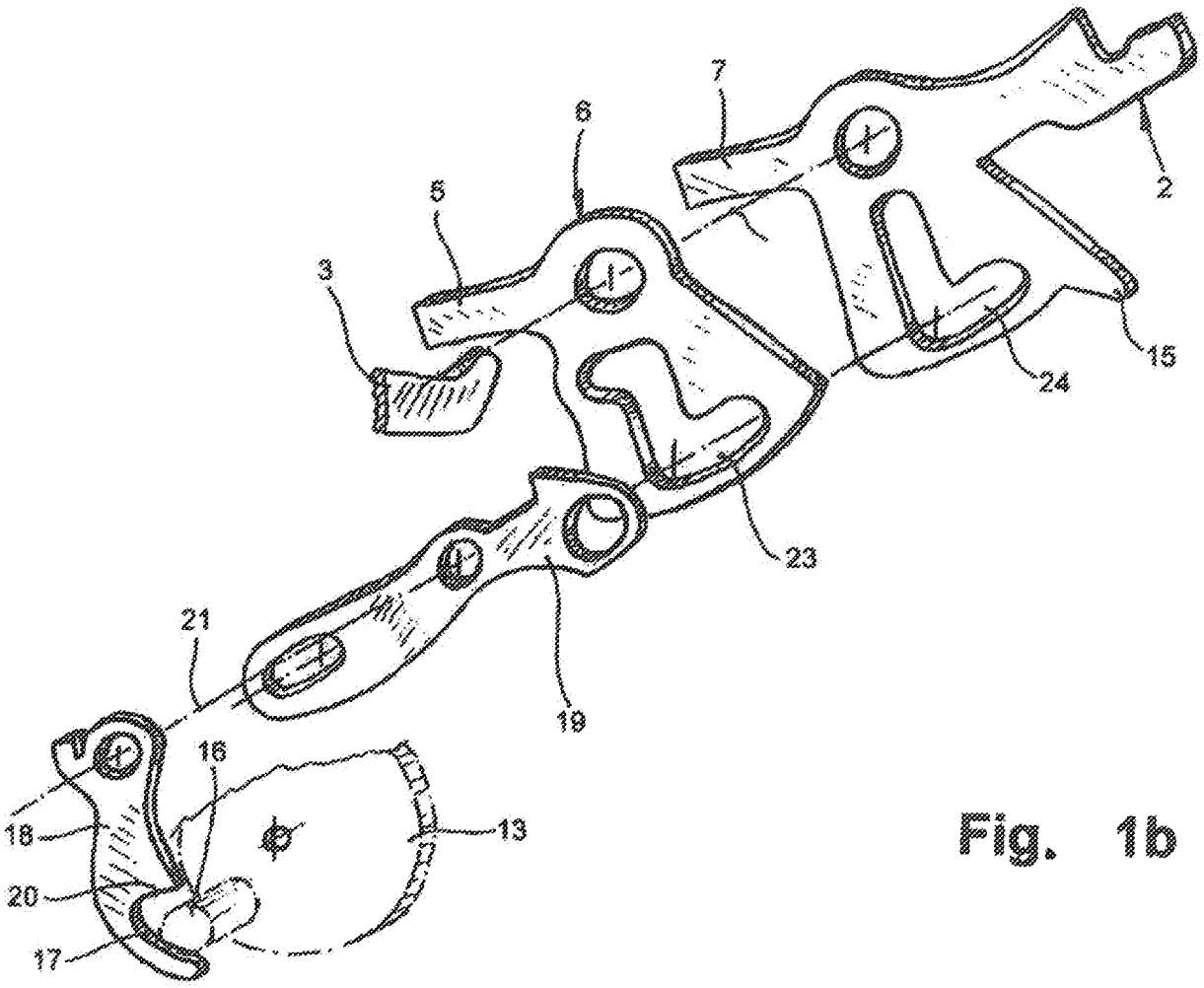
Figure 2:
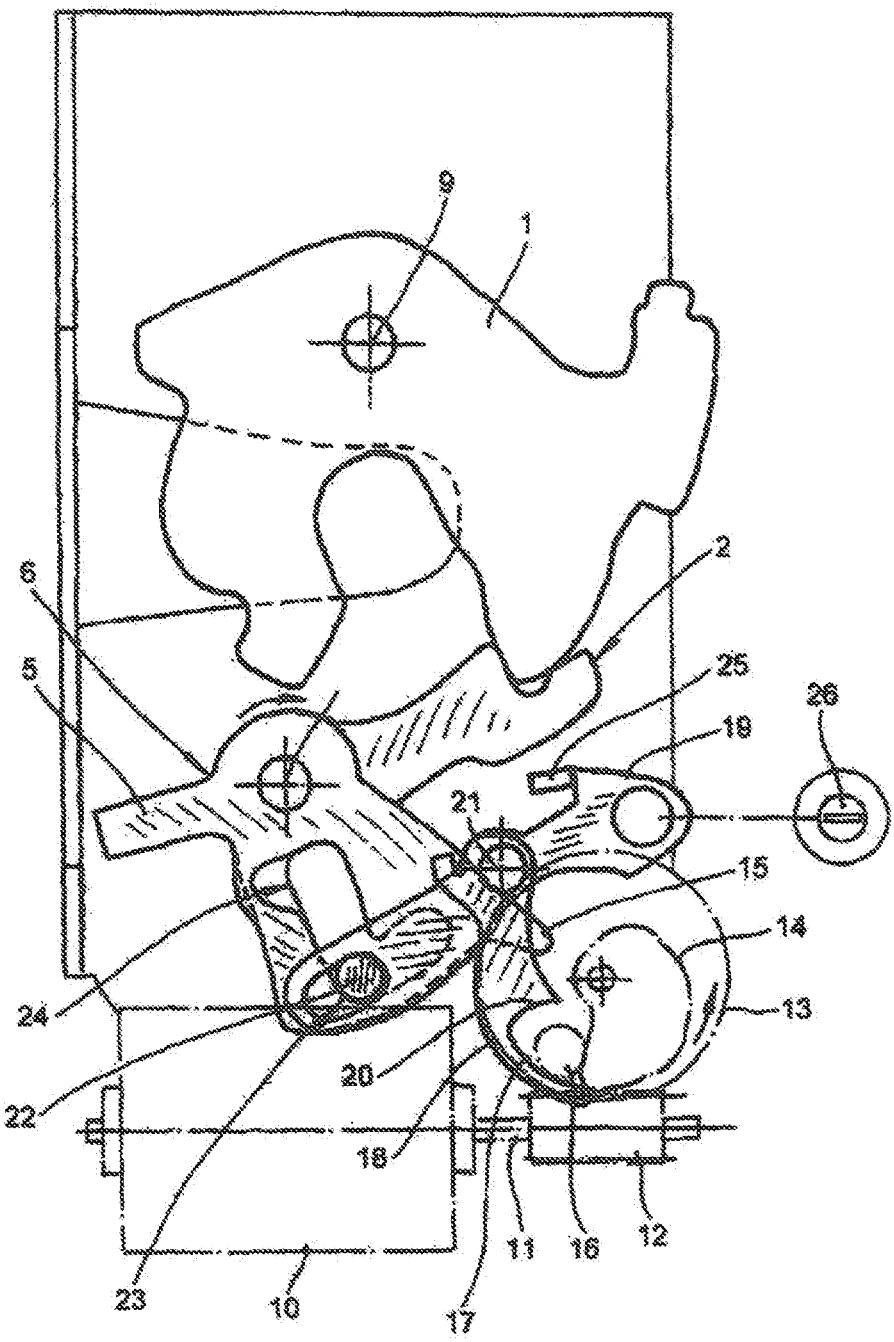
Figure 3:
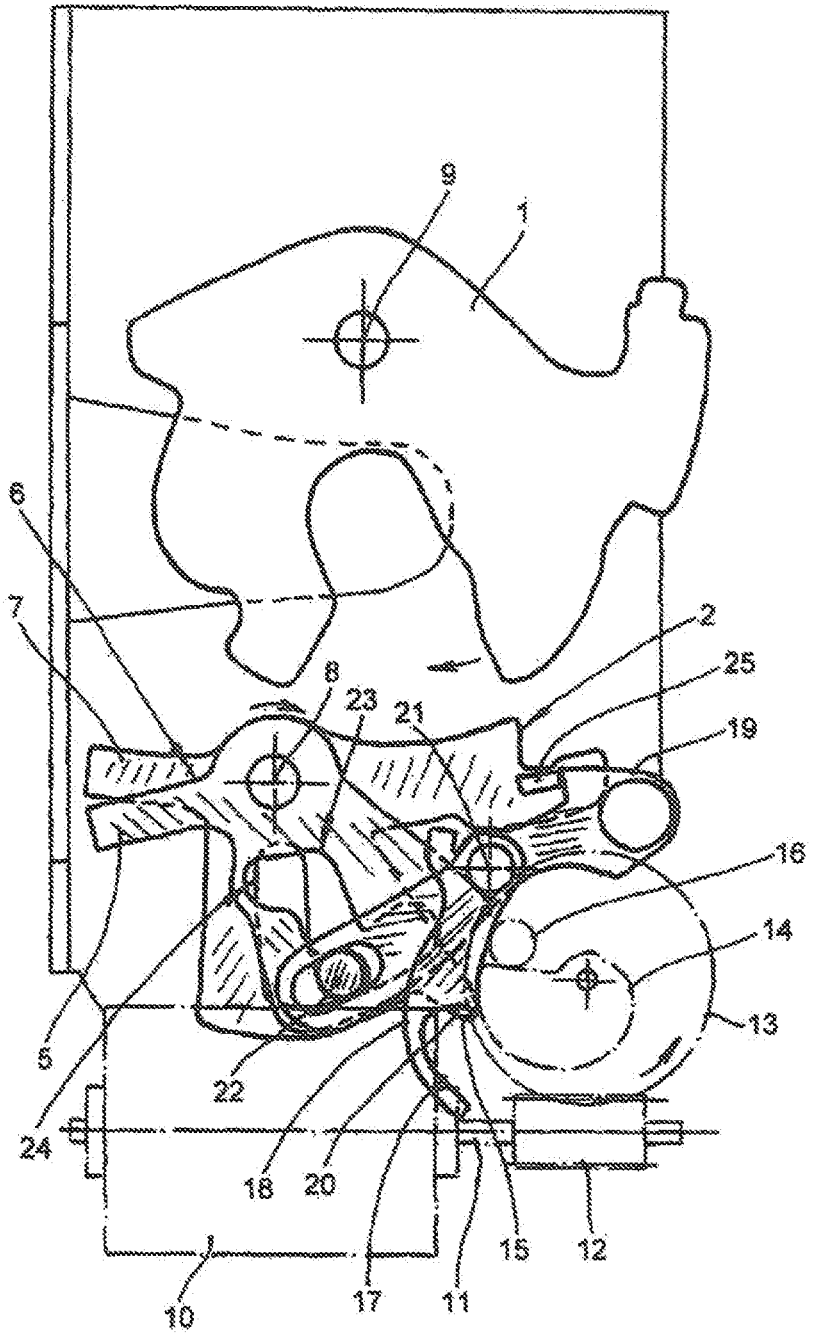
Figure 4:
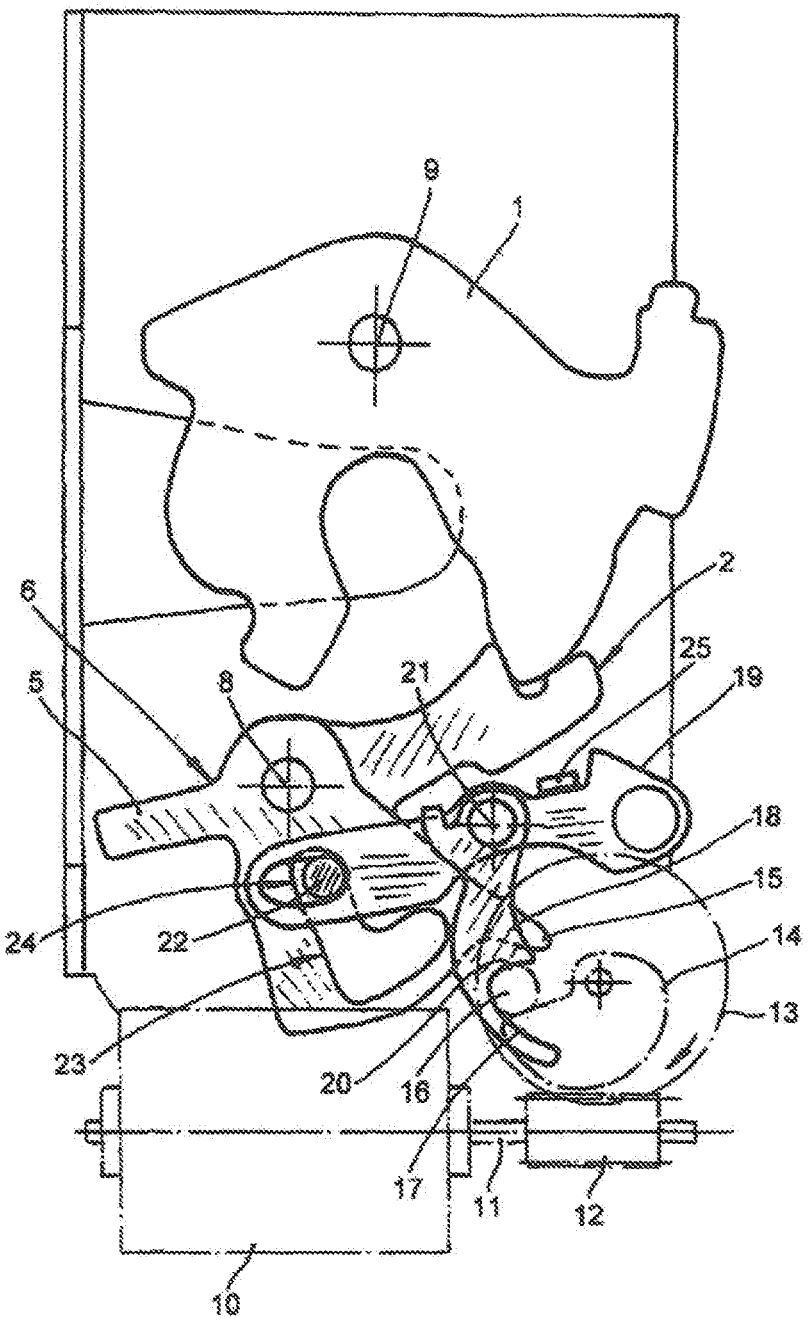
Figure 5:
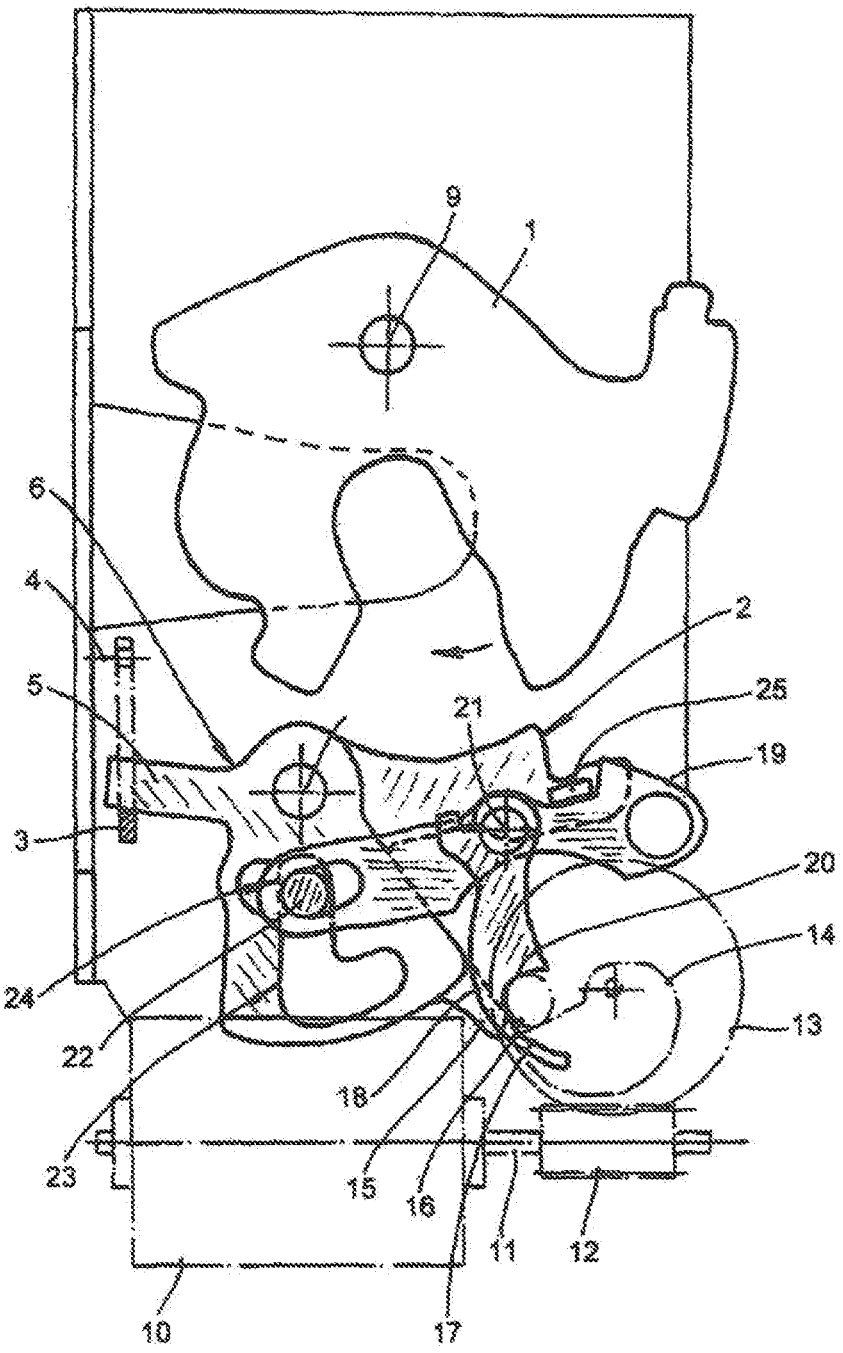
Figure 6:
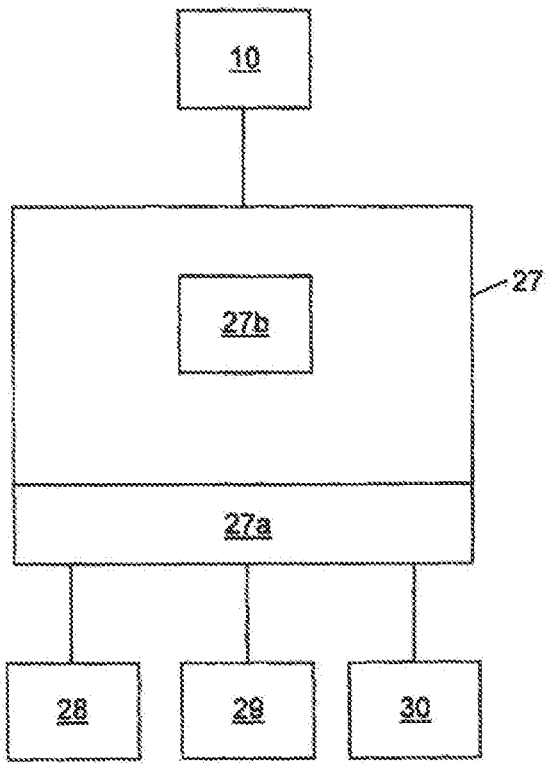

The following are shown:

FIGS. 1*a* and 1*b* an exploded view of the crucial components of a motor vehicle door latch in two different configurations FIG. 2 the motor vehicle door latch according to FIG. 1*b* in the assembled state, in the closed position of the locking mechanism FIG. 3 the motor vehicle door latch according to FIG. 2 after an electrical opening process FIG. 4 the manufacture of a mechanical connection between an actuating mechanism and the locking mechanism for emergency opening FIG. 5 the open locking mechanism after an emergency opening and FIG. 6 a diagrammatic, control block diagram of the motor vehicle door latch In the figures a motor vehicle door latch is depicted which is equipped with a locking mechanism 1, 2 consisting of a catch 1 and a pawl 2. In particular, in the images according to FIGS. 1*a*, 1*b* and 5 an activation lever 3 is recognised in particular, according to the execution example an external activation lever 3 which is mechanically operatively connected to an external door handle. The combination of the external activation handle 3 and the external door handle forms an actuating mechanism for the manual unlocking of the locking mechanism 1, 2. With rotational movements around its axis 4 the activation lever 3 fastens to a jib 5 of a triggering lever 6 (cf. FIG. 5). Relevant pivoting movements of the activation lever 3 lead in the locking mechanism in the closed position (cf. FIG. 2) to the triggering lever 6 and thus also the activation lever 3 and the connected external door handle executing an idle stroke.

That is the usual functionality of the locking mechanism 1, 2 in the closed position of a motor vehicle door latch which can be unlocked by an actuator. Naturally, the locking mechanism 1, 2 can also be opened mechanically in this position, however only by using an internal activation lever connected to an internal door handle and not explicitly illustrated which directly impinges a jib 7 of the pawl 2 to open the catch 1. In other words, this not explicitly illustrated internal activation lever is able to rotate the pawl 2 in the figures around its axis 8 in a clockwise direction. Consequently, the catch 1 also rotates in a clockwise direction around its axis 9 in a spring-assisted manner and is transferred into its opening position indicated by an arrow in FIG. 5.

The pawl 2 can not only be opened with the aid of the internal activation lever, but also electrically. An actuator 10, 11, 12, 13 takes care of this. This electrical actuator 10, 11, 12, 13 consists within the scope of the execution example of an electromotor 10, a pinion shaft 11 rotated by it, a worm gear 12 on the pinion shaft 11 and a pinion disc 13 combing with the worm gear 12. This pinion disc 13 is able to execute rotational movements in a clockwise and anti-clockwise direction.

If the pinion disc 13 is impinged in an anti-clockwise direction, a pinion cam 14 below the pinion disc 13 in the top view in conjunction with a cam counterpart 15 on the pawl 2 ensures that the pawl 2 executes a clockwise direction movement around its axis 8. Consequently, as for the described mechanical opening by means of the internal activation lever engaging on the jib 7 the catch 1 is released with the aid of the spring. This process can be understood with a comparative view of FIGS. 2 and 3. Here, relevant arrow entries ensure that the movement of the individual components of the motor vehicle door latch become clear. The positions of the pinion disc 13 in FIGS. 2 and 3 are normal positions of the actuator as the actuating mechanism is deactivated.

In addition to the described electrical opening of the locking mechanism 1, 2 by an anti-clockwise direction movement of the pinion disc 13 initiated by the electrical actuator 10, 11, 12, 13 the relevant electrical actuator 10, 11, 12, 13 is also able to enable an emergency opening of the locking mechanism 1, 2, i.e. to activate the actuating mechanism. Within the scope of this emergency opening, the locking mechanism 1, 2 is mechanically connected to the activation lever 3 and thus naturally the external door handle. Consequently, this now no longer executes an idle stroke. The motor vehicle door latch attains this emergency opening of the locking mechanism 1, 2 by the pinion disc 13 executing a clockwise movement this time (in contrast to electrical opening, where the pinion disc 13 is moved in an anti-clockwise direction). The position of the pinion disc 13 illustrated in FIG. 4 is therefore an emergency position of the actuator in which the actuating mechanism is activated.

The clockwise direction movement can be understood especially clearly if FIGS. 2 and 4 are compared in this sequence. It thus becomes clear that the control spigot 16 projecting from the pinion disc 13 is pivotably accommodated in a sickle-shaped recess 17 of a crosswise jib 18 of an intermediate lever 19. As soon as the control spigot 16 drives against a stop 20 of the sickle-shaped recess 17, the crosswise jib 18 of the intermediate lever 19 is moved in such a way that the intermediate lever 19 executes a clockwise movement around its axis 21. This clockwise movement illustrated in FIG. 4 results in a round pin 22 found on the intermediate lever 19 moving compared to the position according to FIG. 2 from an end of an L arm of an L-shaped lengthwise hole 23 in the triggering lever 6 to the other end of this L arm.

The same process happens in a mostly congruent L-shaped lengthwise hole 24 of the pawl 2 located beneath. As soon as the round pin 22 has reached the position according to FIG. 4 on the end side of one of the L arms on the respective L-shaped lengthwise holes 23, 24 in the triggering lever 6 and the pawl 2, rotational movements of the activation lever 3 are transformed directly by the jib 5 of the triggering lever 6 in rotational movements of the pawl 2 in a clockwise direction to open the catch 1. This becomes clear during transition from FIG. 4 to FIG. 5.

Within the scope of FIG. 1*a*, the intermediate lever 19 is arranged between the triggering lever 6 and the pawl 2. In principle, the intermediate lever 19 can also be found in front of the triggering lever 6 as shown in FIG. 1*b*.

Normally, i.e. when the locking mechanism 1, 2 is closed the round pin 22 is arranged on one end of the L arm of the L-shaped lengthwise holes 23, 24 as shown in FIGS. 2 and 3. If the activation lever 3 now impinges the jib 5 of the triggering lever 6, the triggering lever 6 is rotated around its axis 8 in a clockwise direction. However, the consequence of this is that the round pin 22 swerves so to speak into the other L-leg of the L-shaped recess 23 of the triggering lever 6. The pawl 2 does not accompany this process. The activation lever 3 and thus the connected external door handle execute an idle stroke.

Overall, it is recognised on the basis of the illustrations that the triggering lever 6 and the pawl 2 are located on the same axis, namely on the axis 8. Furthermore, a stop 25 in the housing ensures that the clockwise rotations of the intermediate lever 19 executed in the course of emergency opening are limited. Finally, FIG. 2 shows that the intermediate lever 19 can be transferred with the aid of a locking cylinder 26 or a comparable mechanical adjuster into the position connecting the triggering lever 6 with the pawl 2. This happens within the scope of the execution example independently of the described emergency opening facilitated with the electrical actuator 10, 11, 12, 13.

Finally, the mechanical connection of the activation lever 3 via the triggering lever 6 to the pawl 2 can be executed in the case of emergency in particular illustrated in FIGS. 4 and 5 if a relevant signal of a non-illustrated sensor is present. Within the scope of the execution example, this sensor is an airbag sensor, the signal of which is evaluated by a control device 27 shown in FIG. 6 and processed to control the electrical actuator 10, 11, 12, 13. In principle, the motor vehicle door latch naturally opens up the possibility of using any sensor signal for the described movement of the pinion disc 13 in a clockwise direction so that emergency opening is activated.

In combination with the pinion shaft 11, the worm gear 12 and the pinion disc 13 the electromotor 10 forms an actuator which acts as both an opening actuator to unlock the locking mechanism 1, 2 and also a switching actuator. The positions of the pinion disc 13 shown in FIGS. 2 and 3 correspond to normal positions of the switching actuator in which the actuating mechanism is deactivated in the form of the external activation lever 3, while in FIG. 4 a position of the pinion disc 3 is illustrated which corresponds to an emergency position of the switching actuator in which the actuating mechanism including the external activation lever 3 is activated.

FIG. 6 shows a diagrammatic control technology block diagram of a motor vehicle door latch from the other figures. A control unit 27 is electrically connected to the electromotor 10 in order to control it. According to the design of the motor vehicle door latch, the control unit generates pure control signals which are transformed by the electromotor 10 or power signals which drive the electromotor 10 directly.

The control unit 27 demonstrates an interface 27*a* via which the control unit 27 can be connected with a counting sensor 28, the vehicle electronics 29 of the motor vehicle in which the motor vehicle door latch can be installed and an activation sensor 30. The interface 27*a* is optional and thus accordingly the connection to each individual element of the counting sensor 28, the vehicle electronics 29 and the activation sensor 30.

Furthermore, the control unit 27 optionally demonstrates an accumulator 27*b*. The accumulator 27*b* contains a counter which is increased by 1 every time if the control unit 27 induces the electromotor 10 to impinge the pinion disc 13 in an anti-clockwise direction, i.e. to unlock the locking mechanism 1, 2 by means of the actuator. If the counter reaches a prescribed value, which defines the prescribed cycle the control unit 27 controls the electromotor 10 in such a way that the pinion disc 13 executes a clockwise direction movement. Thus, as previously described, the locking mechanism 1, 2 is thus mechanically connected to the activation lever 3 and thus also the external door handle. Subsequently, the control unit 27 controls the electromotor 10 in such a way that the pinion disc 13 is rotated back in an anti-clockwise direction into its start position and also resets the counter accumulated in the accumulator 27*b* to the value 0.

Alternatively or additionally, the counter accumulated in the accumulator 27*b* can count the number of openings in the tank lid of the motor vehicle. The counting sensor 28 generates a relevant signal when the tank lid is opened. The control unit 27 increases the counter accumulated in the accumulator 27*b* by 1 each time if such a signal from the counting sensor 28 is present. If the counter reaches a specified state, the electromotor 10 is controlled as described above in order to rotate the pinion disc 13 in a clockwise direction.

The counter set aside in the accumulator 27*b* can also count the number of start processes of the motor vehicle motor or how often a diagnostic device was connected to the motor vehicle electronics 29. In the case of such an event, the motor vehicle electronics 29 generate a relevant signal which leads to the control unit 27 increasing the counter set aside in the accumulator 27*b* by 1 and moving the actuator 10 to 13 into the emergency position when the counter reaches a specified state.

The activation sensor 30 is a sensor which detects when the actuator 10 to 13 should unlock the locking mechanism 1, 2. To this end, the activation sensor 30 detects in particular the activation of a button or switch, a force impact on the actuating mechanism or a deflection of the actuating mechanism. If the activation sensor 30 generates a relevant signal the control unit 27 controls the electromotor 10 in such a way that the pinion disc 13 moves in an anti-clockwise direction into the position illustrated in FIG. 3, i.e. the locking mechanism 1, 2 is electrically unlocked.

In the illustrated execution example, the actuator consisting of the electromotor 10, the pinion shaft 11, the worm gear 12 and the pinion disc 13 acts as both an opening actuator and a switching actuator. However, two separate actors can also be provided for which can preferably both be controlled by the control unit 27. Due to the use of an individual actuator, which acts as both an opening actuator and a switching actuator, the actuator, in particular the pinion disc 13 has two normal positions, namely the positions illustrated in FIGS. 2 and 3, which are in the normal position in the function of an actuator as a switching actuator, i.e. a position in which the actuating mechanism is deactivated.

The invention claimed is:

1. A motor vehicle door latch comprising:

a locking mechanism, an opening actuator to unlock the locking mechanism, an actuating mechanism to unlock the locking mechanism, wherein the opening actuator can assume a normal position and an emergency position, whereby the opening actuator deactivates the actuating mechanism in the normal position and activates the actuating mechanism in the emergency position; and a control unit to control the opening actuator, wherein the control unit is set up in such a way that the opening actuator is moved in a prescribed cycle comprising movement from the normal position to the emergency position wherein the prescribed cycle corresponds to an n-fold number of occurrences of a non-emergency event where n is a whole number.

2. The motor vehicle door latch according to claim 1, wherein the opening actuator is an electrical drive.

3. The motor vehicle door latch according to claim 1, further comprising a switching actuator configured to assume the normal position and the emergency position, wherein the switching actuator is configured to deactivate the actuating mechanism in the normal position and activate the actuating mechanism in the emergency position, and wherein the switching actuator is coupled to the control unit and configured to move in the prescribed cycle.

4. The motor vehicle door latch according to claim 1, further comprising a pinion cam driven by the opening actuator which blocks and thus deactivates the actuating mechanism in the normal position of the opening actuator.

5. The motor vehicle door latch according to claim 1, comprising a coupling mechanism driven by the opening actuator which in the normal position of the opening actuator moves the actuating mechanism with regard to the locking mechanism in an idle stroke and thus deactivates it.

6. The motor vehicle door latch according to claim 1, wherein the prescribed cycle corresponds to the number of openings of the locking mechanism by the opening actuator.

7. The motor vehicle door latch according to claim 1, wherein the prescribed cycle corresponds to the n-fold opening of a tank lid of a motor vehicle in which the motor vehicle door latch is installed, whereby n is a positive whole number.

8. The motor vehicle door latch according to claim 1, wherein the prescribed cycle corresponds to the n-fold connection of a diagnostic device to the vehicle electronics of a motor vehicle in which the motor vehicle door latch is installed, whereby n is a positive whole number.

9. The motor vehicle door latch according to claim 1, wherein the prescribed cycle corresponds to the n-fold starting of the motor of a motor vehicle in which the motor vehicle door latch is installed, whereby n is a positive whole number.

10. A procedure for the operational securing of a motor vehicle door latch with a locking mechanism, an opening actuator to unlock the locking mechanism, an actuating mechanism to unlock the locking mechanism, and wherein, the opening actuator can assume a normal position and an emergency position, whereby the opening actuator deactivates the actuating mechanism in the normal position and activates the actuating mechanism in the emergency position, wherein the opening actuator is moved in a prescribed cycle comprising movement from the normal position to the emergency position wherein the prescribed cycle corresponds to an n-fold number of occurrences of a non-emergency event where n is a whole number.

* * * * *